United States Patent [19]

Cummins

[11] Patent Number: 4,480,357

[45] Date of Patent: Nov. 6, 1984

[54] BUTTON SECURING DEVICE

[76] Inventor: Richard D. Cummins, 6092 Emerson Dr., Orchard Park, N.Y. 14127

[21] Appl. No.: 396,154

[22] Filed: Jul. 8, 1982

[51] Int. Cl.[3] ..... A44B 1/18

[52] U.S. Cl. ..... 24/90 R; 24/16 PB

[58] Field of Search ..... 24/90 TA, 90 R, 90 C, 24/104, 103, 101 R, 150 FP, 155 BB, 16 PB, 30.5 P; 2/265

[56] References Cited

U.S. PATENT DOCUMENTS

| | | | |
|---|---|---|---|
| 2,104,885 | 1/1938 | Robbins | 24/90 R |
| 3,349,447 | 1/1966 | Raleigh, Jr. | 24/90 |
| 3,754,304 | 8/1973 | Modrey | 24/90 |
| 3,780,400 | 12/1973 | Hinsperger | 24/16 |
| 3,785,009 | 1/1974 | Nysten | 24/90 |
| 3,816,881 | 6/1974 | Van Riper, Jr. | 24/90 |
| 3,894,317 | 7/1975 | Nysten | 24/90 |
| 4,063,312 | 12/1977 | Braillard | 2/265 |
| 4,136,148 | 1/1979 | Joyce | 24/16 PB |
| 4,232,427 | 11/1980 | Mawhinney et al. | 24/90 |

*Primary Examiner*—Mickey Yu

*Attorney, Agent, or Firm*—Bean, Kauffman & Bean

[57] ABSTRACT

A button securing device having a base portion; a standoff post joined to the base portion and formed with a locking slot; and a filament portion joined to the standoff post and adapted to be passed in a single direction through a fabric to which a button is to be attached sufficiently to pull the standoff post through the fabric and position the fabric against the base portion, threaded through holes of the button and finally secured within the locking slot of the standoff post. The height of the standoff post determines the standoff distance or spacing between the button and the fabric.

9 Claims, 7 Drawing Figures

BUTTON SECURING DEVICE

BACKGROUND OF THE INVENTION

The present invention relates to button securing devices and more particularly to one piece molded plastic devices of the type adapted for use in securing a button to fabric without sewing or using a needle and thread.

It has heretofore been proposed to provide one piece plastic button securing devices comprising a base portion having a locking slot and a filament portion joined to the base portion and adapted in sequence to be passed through a fabric to which a button is to be attached sufficient to position the base portion against the fabric, threaded through holes of the button, again passed through the fabric, but in a reverse direction, and finally secured within the locking slot of the base portion. Prior U.S. patents of interest relative to this type of button securing device include Nos. 3,349,447; 3,754,304; 3,785,009; 3,894,317 and 4,232,427. Additionally, U.S. Pat. No. 4,232,427 discloses alternative constructions, wherein a base portion may be fitted with either one or two filament portions, depending on the number of holes in the button to be secured. These prior patented constructions are believed to possess two main drawbacks, namely, the difficulty/inconvenience of again passing the filament portion through the fabric after its having been threaded through the button holes, and their inability to provide for a desired standoff distance or spacing between the button and the fabric unless the filament portion is threaded through a separately fabricated spacer ring or bead, as disclosed in U.S. Pat. Nos. 3,754,304 and 4,232,427.

U.S. Pat. No. 4,063,312 discloses a button securing device, which overcomes the problem of providing for a desired standoff distance between a button and fabric without the need for a separately fabricated spacer ring or bead. However, in this patented device, the filament portion must still be passed back and forth through the fabric.

SUMMARY OF THE INVENTION

The present invention is directed towards an improved one piece button securing device, and more particularly to a device of this type providing for a desired standoff distance or spacing between a button and fabric to which it is secured, while avoiding multiple passages of a filament portion of the device through the fabric.

The button securing device of the present invention comprises a base portion; a standoff post joined to the base portion and formed with a locking slot; and a filament portion joined to the standoff post and adapted to be passed in a single direction through a fabric to which a button is to be attached sufficiently to pull the standoff post through the fabric and position the fabric against the base portion, threaded through holes of the button and finally secured within the locking slot of the standoff post. In an alternative construction, the device is provided with a pair of standoff posts and an associated pair of filament portions.

In all forms of the present invention, the height of the standoff post determines the standoff distance or spacing between the button and the fabric. The construction of the standoff post and/or lengths of the filament portion projecting from within the locking slot are adapted to retain the base portion and fabric in close proximity.

DRAWINGS

DETAILED DESCRIPTION

Figure 1:
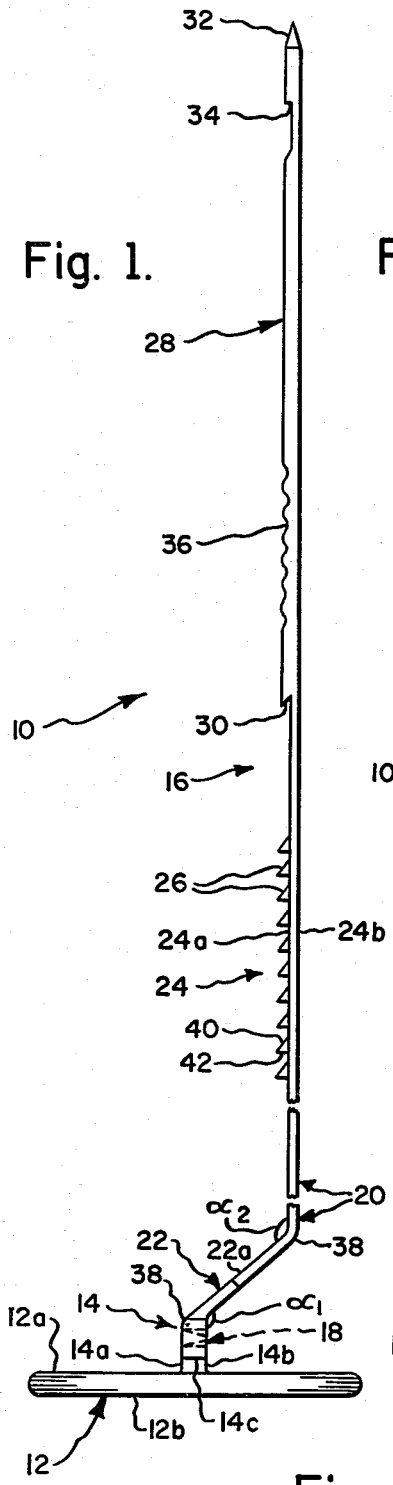
FIG. 1 is a side elevational view of a button securing device formed in accordance with a preferred form of the present invention.
Figure 2:
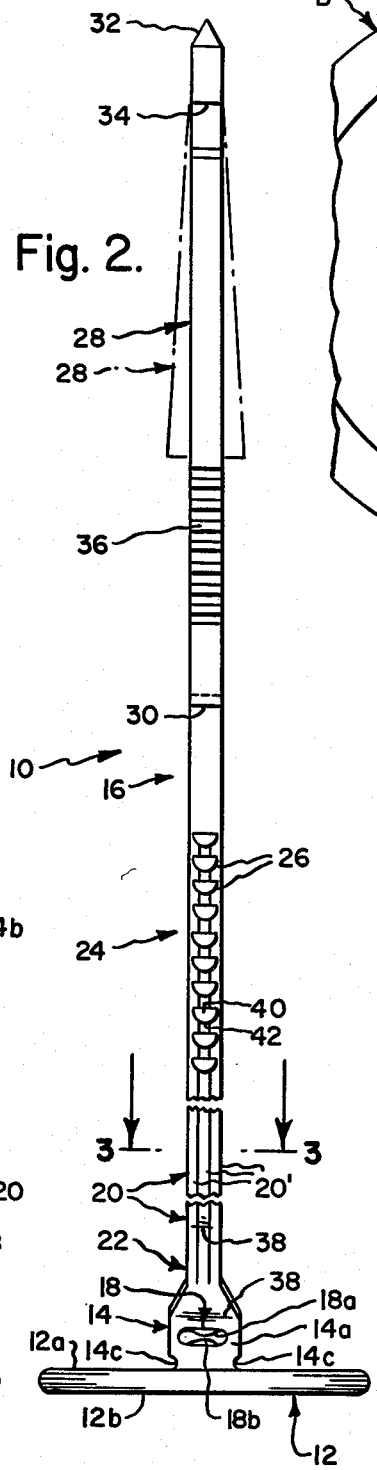
FIG. 2 is a front elevational view thereof.

Reference is first made to FIGS. 1 and 2, wherein a button securing device formed in accordance with a preferred form of the present invention is designated as 10 and shown as generally comprising a base portion 12, a standoff post 14 and a filament portion 16. Device 10 may be fabricated by an injection molding operation employing any suitable tough and flexible synthetic plastic material, such as commonly proposed for use in forming prior one piece plastic button securing devices.

In the following description the letters "B" and "F" are employed, respectively, to designate a button and fabric to which such button is to be secured by means of device 10. The letters "O" and "H" are employed, respectively, to designate the single hole or opening in the fabric made by passage of filament portion 16 therethrough and holes provided in button "B". It will be understood that the term "fabric" is intended to include any thin, flexible sheet material to which a button may be applied by use of a needle and thread, and thus is not limited to a woven fabric material.

Base portion 12 is depicted in the drawings as being in the form of a thin circular plate or disc having essentially flat upper and lower surfaces **12*a* and 12*b*, respectively, but its construction is not limited thereto. Rather, it is only necessary that base portion 12** be of sufficient size and rigidity to prevent its being pulled through a piece of fabric "F" during or subsequent to a button securing operation.

Standoff post 14 is shown in the drawings as being in the form of a flat, generally rectangular plate, which has front and rear surfaces **14*a* and 14*b*, respectively, and is arranged to upstand centrally of upper surface 12*a* of base portion 12. The height of standoff post 14, as measured normal to base portion 12, is a matter of choice depending upon the desired standoff distance or spacing between fabric "F" and button "B" after the latter is secured in place in the manner to be hereinafter described. Standoff post 14 is formed with a locking slot 18 having a filament portion entrance end opening through front surface 14*a* and an exit end opening through rear surface 14*b*; and preferably has notches 14*c* and 14*c* provided in its opposite marginal edges adjacent the juncture thereof with base portion 12, as best shown in FIG. 2**.

Figure 6:
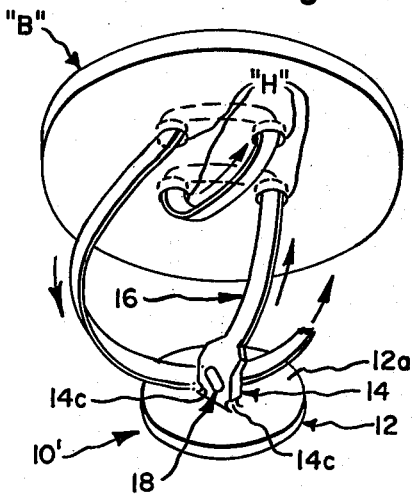
FIG. 6 is a diagrammatic perspective view intended to illustrate the mode of threading the filament portion through the button depicted in FIG. 5.
Figure 4:
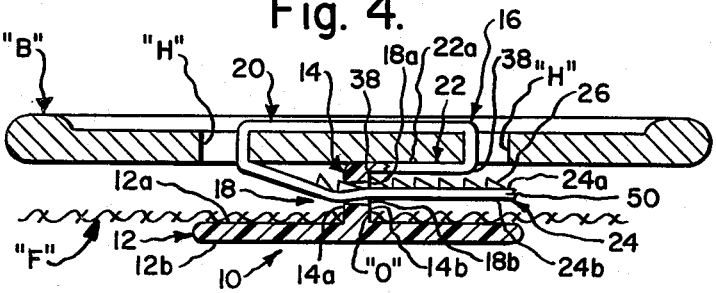
FIG. 4 is a sectional view of the device showing its utilization in securing a button to a piece of fabric.

By viewing FIGS. 2 and 4, it will be understood that locking slot 18 has an oblong cross-sectional configuration with a minimum or heightwise dimension larger adjacent its entrance end than adjacent its exit end, whereby it is tapered lengthwise thereof and cooperates with rear surface 14*b* to define a locking edge 18*a* and a backup edge 18*b*. Preferably, the exit end of locking slot 18 is of a bar-bell cross-sectional configuration, as best shown in FIG. 2, such that the marginal edges of the locking slot are of equal height throughout its length and only the central or mid portion of the locking slot is actually tapered, whereby edges 18*a* and 18*b* are in the form of tabs having a greater degree of flexibility than would be the case if such edges were to extend entirely between the marginal edges of the locking slot. Locking slot 18 may be disposed essentially parallel to upper surface 12*a* of base portion 12 as shown in FIG. 2, or tilted relative thereto, as shown in FIG. 6, for the reasons to be hereinafter discussed.

Filament portion 16 is of a multi-part design including a thread section 20, which is joined to standoff post 14 by a transition section 22; a locking section 24, which is joined to the thread section and provided on its front surface 24*a* with a series of uniformly spaced ratchet or locking teeth 26; and a gripping/needle section 28, which is joined to the locking section and cooperates therewith to define an undercut recess or "push through" notch 30. Gripping/needle section 28 is provided with a pointed needle end or tip 32 of square pyramid design and a "pull through" notch 34 arranged immediately adjacent the needle end, and is preferably provided with a roughened surface(s), such as that designated at 36, to facilitate gripping thereof by the fingers of a user of device 10. Push through notch 30 and pull through notch 34 are sized to receive the fingernail of a user of button securing device 10 in order to facilitate in succession the pushing and pulling of gripping-/needle section 28 through fabric "F" to form opening "O".

In a preferred form of the present invention, filament portion 16 has an oblong cross-sectional configuration and with the exception of transition section 22, a uniform width as measured between its opposite marginal edges, is shown in full line in FIG. 2. The cross-sectional size and configuration of filament portion 16 is such as to permit same to be threaded through holes "H" of button "B" and finally passed through locking slot 18 for purposes of attaching the button to fabric "F". Alternatively, however, gripping/needle section 28 may be tapered lengthwise thereof, as indicated in broken line in FIG. 2, so as to provide a substantially increased cross-sectional size at a point spaced from needle end 32 with a view to creating a hole "O" in fabric "F", which is of sufficient size to freely receive and permit passage therethrough of standoff post 14. However, in this form of the invention it is necessary to sever or otherwise remove gripping/needle section 28 from locking section 24 prior to threading the filament portion through button holes "H" and locking slot 18.

Transition section 22 is shown in FIG. 1 as having an as-formed configuration, wherein it is arranged at angles $\alpha$ and $\alpha_2$ of other than 180° with respect to standoff post 14 an adjacent portion of filament portion 16 to which it is joined, that and thread section 20, so as to define bend or hinge areas 38 and 38; and in FIG. 2 as having its marginal edges arranged to converge in a direction towards the thread section. Angles $\alpha$ and $\alpha_2$ would preferably be equal and have values of between 90° and 180° in order to facilitate manufacture of button securing device 10. The length of transition section 22 as measured between bend areas 38 and 38 would preferably be equal to about one-half of the distance between button holes "H", as best shown in FIG. 4.

Figure 3:
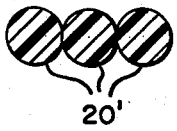
FIG. 3 is a sectional view taken along line 3—3 in FIG. 2.

Preferably, thread section 20 is divided lengthwise thereof as an incident to the mold forming operation to define separate or individual thread elements 20', 20' and 20' having generally circular cross-sectional configurations, as best shown in FIG. 3. If desired, the thread elements may be extended into locking section 24 in which case they would be transversely interconnected by teeth 26 in the manner best shown in FIG. 2.

Teeth 26 are preferably characterized as having camming surfaces 40, which face in the direction of gripping/needle section 28 and rounded locking surfaces 42, which face in the direction of base portion 12. When locking section 24 is passed through locking slot 18 its rear surface 24*b* is arranged to slidably engage with backup edge 18*b* and teeth cam surfaces 40 are arranged to engage with locking edge 18*a* with the result that locking edge 18*a*, and possibly to some extent, teeth 26 and backup edge 18*b*, is resiliently deformed sufficiently to permit passage of the locking section through the locking slot. However, retrograde movement of locking section will be subsequently prevented due to engagement of the upstanding locking surfaces 42 with the planar rear surface of locking edge 18*a*, which corresponds to standoff post rear surface 14*b*.

Operation of a first form of button securing device 10, which is particularly adapted for use with a button "B" having a pair of holes "H" will now be described with reference to FIG. 4; it being understood that in this form of the invention locking slot 18 may be disposed essentially parallel to base portion 12, as best shown in FIG. 2 and that thread portion 20 is of a length sufficient to permit same to bridge between button holes "H" when locking section 24 is secured within the locking slot. It will be understood that filament portion 16 is in sequence passed in a single direction through fabric "F" to create opening "O" and to pull standoff post 14 through such opening sufficiently to position the fabric against base portion 12. Filament portion 16 is then threaded through button holes "H" and finally passed through locking slot 18 sufficiently to position button "B" in proximity to standoff post 14 adjacent the juncture thereof with the filament portion; locking section 24 thereafter cooperating with locking edge 18*a* and backup edge 18*b* to prevent retrograde movement of the filament portion from within locking slot 18 after having been passed therethrough. Thereafter, gripping-/needle section 28, and if desired, any portion of locking section 24, which excessively protrudes beyond standoff post rear surface 14*b* may be severed, as at 50. It is preferable to draw locking section 24 through locking slot 18 sufficiently to draw the bottom surface of button "B" downwardly into engagement with the front surface 22*a* of transition section 22, whereafter bend areas 38 and 38 flex to permit the bottom surface of the button to be seated on the upper end of standoff post and to assume a position in which such bottom surface is essentially parallel to base portion 12. The provision of transition section 22 having a length corresponding to about one-half of the distance between button holes "H" permits the button "B" to be approximately centered relative to standoff post 14 and base portion 12. It will also be understood that the edges of fabric bounding opening "O" tend to protrude into standoff post notches 14*c* and 14*c* with the result that fabric "F" tends to be maintained in engagement with the upper surface 12*a* of base portion 12 and thus in a desired standoff distance from the bottom surface of button "B". If, however, notches 14c and 14c do not prove effective in any particular instance to retain fabric "F" at this maximum standoff distance, the presence of locking slot 18 in relatively close proximity to upper surface 12a serves to arrange the rear surface 24b of locking section 24 for engagement with the fabric so as to prevent any substantial movement thereof upwardly along the standoff post, thereby maintaining an acceptable standoff distance.

Reference is now made to FIG. 6, which illustrates the mode of threading filament portion 16 through a button "B" having two pairs of holes "H". The construction of button securing device 10' generally depicted in FIG. 6 is identical to that previously described with reference to FIGS. 1–4 with the exception that it is preferably to tilt locking slot 18 relative to base portion upper surface 12a, such that when locking section 24 is passed therethrough it will also be tilted relative to surface 12a such that its opposite lengthwise extending marginal edges will be disposed relatively adjacent to and relatively remote from such surface. Also when the present button securing device is intended to be used with a button having four holes, it would normally be desirable to slightly increase the length of thread portion 20 over that required for use with a button having only two holes.

Figure 5:
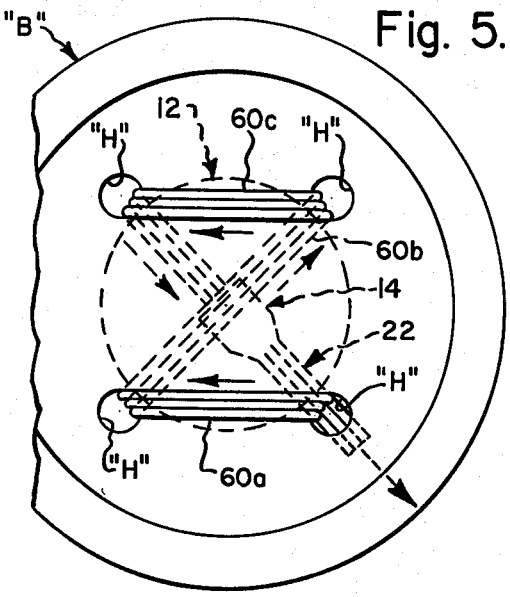
FIG. 5 is a top plan view of a button having two pairs of holes through which is threaded a filament portion of the present button securing device.

FIG. 5 shows the top surface of button "B" after filament portion 16 of device 10' has been threaded through its two pairs of holes in the manner illustrated in FIG. 6. It is important to note that the provision of separate thread elements 20', 20' and 20' permits relative longitudinal shifting or stretching therebetween, as required to permit the thread portion to be bent or twisted in passing through the button holes, while permitting the successive straight runs 60a, 60b and 60c of the thread section to lie flatwise against the upper and lower surfaces of the button. Further, the tilting of locking slot 18 facilitates insertion and locking of filament portion therewithin when device 10' is diagonally threaded in the manner shown in FIGS. 5 and 6. An additional advantage obtained from using a tilted locking slot, particularly when fabric "F" is relatively thick, is that the locking slot may be positioned at a sufficient distance from base portion 12 to facilitate introduction of the filament portion thereinto, while at the same time a marginal edge of the filament portion is positioned relatively adjacent the base portion so as to restrict movement of the fabric upwardly along the standoff post.

Figure 7:
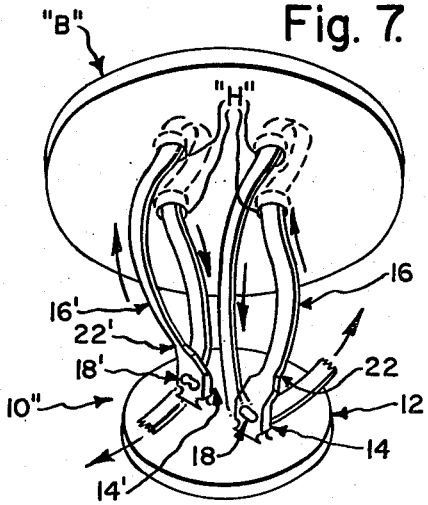
FIG. 7 is a view similar to FIG. 6, but showing an alternative form of the invention featuring the utilization of a pair of standoff posts and their associated filament portions.

Reference is now made to FIG. 7 wherein the further alternative form of the securing device of the present invention is generally designated as 10'' and shown as being adapted for use with buttons having two pairs of holes "H". In this form of the invention an additional standoff post 14' having a locking slot 18' is arranged to upstand from base portion 12 in an essentially coplanar relationship to standoff post 14 and is joined to a filament portion 16' by a transition section 22'. It is characteristic of this construction that standoff post 14 and filament portion 16 face in an opposite direction to additional standoff post 14' and filament portion 16', such that transition section 22 and additional transition section 22' diverge in a direction extending away from base portion 12 when in their asformed configurations. As a result, when button "B" is secured in position, transition section 22 and additional transition section 22' lie essentially within a common plane and extend in opposite directions relative to a plane vertically bisecting standoff post 14 and additional standoff post 14', thereby providing a stable platform or symmetrical support for button "B" in order to prevent tilting thereof relative to base portion 12. This arrangement has the additional advantage of providing for uniform thread tensioning conditions.

What is claimed is:

1. A button securing device for attaching a button having at least one pair of holes to a piece of fabric, said securing device comprising:

a base portion;

a standoff post for maintaining said button in a spaced relationship relative to said base portion, said standoff post being joined to said base portion and having a locking slot extending therethrough; and a filament portion including a transition section having opposite ends thereof joined by hinge areas to said standoff post and an adjacent portion of said filament portion, said filament portion having a length sufficient to permit same in sequence to be passed in a single direction through said fabric to create an opening in said fabric and to pull said standoff post through said opening to position said fabric against said base portion, to be threaded through said pair of holes and to be passed through said locking slot sufficiently to draw said button for engagement with said transition section and to position said button in proximity to said standoff post adjacent the juncture thereof with said transition section wherein said button in disposed essentially parallel to said base portion, said transition section has a length as measured between said hinge areas corresponding to about one-half of the distance between holes of said pair of holes whereby to permit said button to be approximately centered relative to said standoff post, and said hinge areas are defined by providing said transition section with an as-formed configuration, wherein it is arranged at angles other than 180° with respect to said standoff post and said adjacent portion of said filament portion and said filament portion and said standoff post cooperate to define locking means tending to prevent retrograde movement of said filament portion from within said locking slot after being passed therethrough, and said base portion, said standoff post and said filament portion are integrally mold formed from resiliently deformable material.

2. A button securing device according to claim 1, wherein said securing device is adapted for use with buttons having an additional pair of holes and further comprises an additional standoff post joined to said base portion and having an additional locking slot, and an additional filament portion joined to said additional standoff post and intended in sequence to be passed through said fabric in said single direction, threaded through said additional pair of holes and secured within said additional locking slot, said standoff post and said additional standoff post are disposed in an essentially coplanar relationship, said additional filament portion includes an additional transition section having its opposite ends joined by hinge areas to said additional standoff post and an adjacent portion of said additional filament portion, said additional transition section having a length corresponding to about one-half of the distance between holes of said additional pair of holes and an as-formed configuration, wherein it is arranged at essentially equal angles other than 180° with respect to said additional standoff post and said adjacent portion of said additional filament portion, and said transition section and said additional transition section diverge in a direction away from said base portion.

3. A button securing device according to claim 1, wherein said adjacent portion of said filament portion includes a thread section joined to said transition section and having a length sufficient for threading through said pair of button holes, and said filament portion additionally includes a locking section joined to said thread section and cooperating with said standoff post to define said locking means, and a gripping/needle section joined to said locking section and cooperating therewith to define a push through notch, said gripping/needle section having a pointed free end and a pull through notch arranged adjacent said free end, said push through notch and said pull through notch being sized to receive the finger nail of a user to facilitate in succession pushing and pulling of said needle section through said fabric in said single direction.

4. A button securing device according to claim 3, wherein said thread section has a length sufficient for threading through holes of a button having two pairs of holes, said standoff post is of plate-like configuration having front and rear surfaces arranged to upstand from an essentially flat surface of said base portion, said locking slot extends between said front and rear surfaces and has an oblong cross-sectional configuration tilted relative to said flat surface, and said locking section has an oblong cross-sectional configuration, whereby said locking section when passed through said locking slot is tilted relative to said flat surface to position opposite lengthwise extending marginal edges thereof relatively adjacent to and relatively remote from said flat surface.

5. A button securing device according to claim 4, wherein said transition section overlies said rear surface, said locking slot has a filament portion entrance end opening through said front surface and an exit end opening through said rear surface, said oblong cross-sectional configuration of said locking slot has a minimum dimension larger adjacent said entrance end than adjacent said exit end, whereby said locking slot is tapered lengthwise thereof and cooperates with said rear surface to define a locking edge and a backup edge spaced from said locking edge, said oblong cross-sectional configuration of said locking slot has a maximum dimension exceeding a corresponding maximum dimension of said locking section, as measured between said marginal edges, said locking means is defined by a series of ratchet teeth upstanding from and spaced apart lengthwise of a front surface of said locking section and a rear surface of said locking section and said locking edge and said backup edge, said teeth have camming surfaces facing in the direction of said gripping/needle section and rounded locking surfaces facing towards said base portion, said camming surfaces engage with said locking edge to resiliently deform said teeth and locking edge when said locking section is passed through said locking slot, with said rear surface of said locking section engaged with said backup edge, and said locking surfaces engage with said locking edge to prevent said retrograde movement.

6. A button securing device according to claim 4 or 5, wherein said thread section is divided lengthwise thereof to define separate thread elements having generally circular cross-sectional configurations.

7. A button securing device according to claim 3 or 4, wherein said gripping/needle section has a cross-sectional size spaced from said free end exceeding the cross-sectional size of said standoff post and said transition, thread and locking sections, whereby to permit formation of said opening of a size permitting pulling of said standoff post therethrough, while requiring the severing of said gripping/needle section from said filament portion prior to threading of said filament portion through said locking slot.

8. A button securing device according to claim 1, wherein said locking slot has an oblong cross-sectional configuration tilted relative to said base portion, and that portion of said filament portion cooperating to define said locking means has an oblong cross-sectional configuration, whereby when the last said portion of said filament portion is passed through said locking slot its lengthwise extending marginal edges are disposed relatively adjacent to and relatively remote from said base portion.

9. A button securing device according to claim 1, wherein said standoff post is formed with notch means adjacent the juncture thereof with said base portion for receiving edge portions of said fabric bounding said opening.

* * * * *